US007455559B2

(12) United States Patent
Ito et al.

(10) Patent No.: US 7,455,559 B2
(45) Date of Patent: Nov. 25, 2008

(54) SHIFT CUTOUT CONTROL SYSTEM FOR A WATERCRAFT PROPULSION UNIT AND A WATERCRAFT

(75) Inventors: Makoto Ito, Shizuoka-ken (JP); Takahiro Oguma, Shizuoka-ken (JP); Takashi Okuyama, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/694,468

(22) Filed: Mar. 30, 2007

(65) Prior Publication Data

US 2007/0270054 A1 Nov. 22, 2007

(30) Foreign Application Priority Data

May 19, 2006 (JP) ..... 2006-140539

(51) Int. Cl.
*B63H 20/14* (2006.01)

(52) U.S. Cl. ..... 440/75; 440/86; 440/87

(58) Field of Classification Search ..... 440/1, 440/75, 86, 87; 477/101, 109, 111–113
See application file for complete search history.

(56) References Cited

U.S. PATENT DOCUMENTS 6,942,530 B1 * 9/2005 Hall et al. ..... 440/1
2006/0135314 A1 * 6/2006 Shomura et al. ..... 477/109

FOREIGN PATENT DOCUMENTS

JP 02-216391 8/1990

* cited by examiner

*Primary Examiner*—Ed Swinehart
(74) *Attorney, Agent, or Firm*—Knobbe Martens Olson & Bear LLP

(57) ABSTRACT

A shift cutout control system is provided that can comprise a shift mechanism, an engine electronic control unit, a remote controller, and an ignition control means. The shift mechanism can switch a rotation of a propeller shaft into one of a neutral, forward, and reverse drive state. The propeller shaft can be driven by an output power of an engine. The engine electronic control unit can control a drive state of the engine. The remote controller can transmit a control signal to the engine electronic control unit to achieve a target drive state. The ignition control means can initiate an ignition cutout in the engine when an operating position signal from a lever position detector indicates that a control lever is in a neutral position and a shift position signal from a shift position detector indicates that a shift position is not in neutral.

14 Claims, 7 Drawing Sheets

SHIFT CUTOUT CONTROL SYSTEM FOR A WATERCRAFT PROPULSION UNIT AND A WATERCRAFT

CROSS-REFERENCE TO RELATED APPLICATIONS

The present application is based on and claims priority under 35 U.S.C. § 119 to Japanese Patent Application No. 2006-140539, filed on May 19, 2006, the entire contents of which is expressly incorporated by reference herein.

BACKGROUND

1. Field of the Inventions

The present inventions generally relate to engine control systems, and more specifically, to a shift cutout control system to facilitate interception of the power transmission, i.e. shift cutout, in an internal combustion engine having ignition cutout control for deactivating certain cylinder(s).

2. Description of the Related Art

An outboard motor of a watercraft uses power transmitted from an internal combustion engine to drive a propeller. This power is controlled by shifting a control lever among a forward position (causing propeller rotation in forward direction), a neutral position, and a reverse position (causing propeller rotation in an opposite direction), which shifting actuates a dog clutch. In the case of hard deceleration during the high-speed operation of the engine, shift cutout cannot be performed by merely lowering the throttle or dropping the engine rpm. A shift cutout control is implemented in such situations to reduce the torque of the engine by suspending the ignition operation in certain cylinder(s).

One example of the conventional shift cutout control device, as shown in FIGS. 6 and 7, has a shift cutout switch in the shifting force transmission path. The torque of the internal combustion engine is reduced by cutting out the ignition in the engine once the shift cutout switch detects a shifting force that exceeds the predetermined level. See e.g. Japanese Patent Document No. JP-A-Hei 2-216391.

The example shown in FIGS. 6 and 7 uses a mechanical remote control device for controlling shift cutout. As shown, a movable bracket 54 has a guide rail 53 that is supported swingably by a bearing section 52. The bearing section 52 is provided on a fixed bracket 51 that is fastened in the area around the internal combustion engine 50. A roller 55 is assembled into the guide rail 53 such that it rolls in the guide rail 53. A pin 56 is inserted through a center of the roller 55. A terminal of a remote control cable 57 is joined to one end of the pin 56, and an end of the connecting lever 58 is joined to the other end of the pin 56. The other end of the connecting lever 58 is joined to a free end of a lever 60 that is connected to a shift rod 59. The shift rod 59 is used for operating the dog clutch (not shown) such that a propeller rotation can be switched among neutral, forward, and reverse.

The fixed bracket 51 has a first stopper 61 for blocking the movable bracket 54 from clockwise rotation, as in the FIG. 6. In addition, a torsion spring 63 is interposed between the fixed bracket 51 and the movable bracket 54 around a support shaft 62. A biasing force is imposed by the torsion spring 63, causing the movable bracket 54 to be constantly biased against the first stopper 61.

The fixed bracket 51 has a shift cutout switch 64, and the movable bracket 54 has a pressing part 65. The pressing part 65 closes the contact point of the shift cutout switch 64 when the movable bracket 54, resisting the force of the torsion spring 63, is rotated counterclockwise in FIG. 6 from a butting position against the first stopper 61. Also, the fixed bracket 51 has a second stopper 66 for blocking the counterclockwise rotation of the movable bracket 54 after the contact point of the shift cutout switch 64 is closed.

In conventional shift cutout control devices similar to that described above, the roller 55 is moved along the guide rail 53 by the shifting force exerted on the remote control cable when the control lever of the remote controller is rotated. The movement of the roller 55 results in corresponding movement of the connecting lever 58, which is joined to the roller 55. Then, the lever 60 joined to the connecting lever 58 makes a swinging motion to rotate the shift rod 59, which causes the shifting of the dog clutch. On the other hand, as the roller 55 is moved along the guide rail 53, the shifting force from the forward position to the neutral position (shifting force fF) or the shifting force from the reverse position to the neutral position (shifting force fR) imposes a given preset level of force (namely the shifting force necessary to shift back to neutral position from forward or reverse position). Then, the movable bracket 54 rotates counterclockwise to turn on the shift cutout switch by the pressing part 65. The turn-on signal of the shift cutout switch 64 is transferred to the ignition control circuit of the internal combustion engine 50. Receiving the turn-on signal, the ignition control circuit determines that the shift cutout switch 64 has sensed the occurrence of shifting force fF or fR exceeding the given level, and implements the ignition cutout in the internal combustion engine 50 to reduce its torque. The shift cutout operation is therefore facilitated in this manner.

In the case of shift cutout control systems of the conventional mechanical remote control devices described above, the shift cutout switch 64 is used to detect the conditions for initiating the shift cutout. Simply, the shift cutout switch 64 mechanically reads the shifting force transmitted to the remote control cable 57 through the rotating motion of the control lever. In such a system, the performance of the shift cutout control is dependent on the quality of the shift cutout switch 64, and the space for attaching the shift cutout switch 64 must be maintained on the internal combustion engine 50.

SUMMARY OF THE INVENTIONS

According to at least one of the embodiments disclosed herein, a shift cutout control system is provided to mitigate and/or eliminate the problems related to the conventional shift cutout control devices described above. In particular, embodiments of the shift cutout control system can intercept power transmission from an engine in the event of certain circumstances (hereinafter such interception of the power transmission will be referred to as "shift cutout"). For example, an object of the present inventions is to provide a compact shift cutout control system that utilizes an electronic remote control device to obtain highly reliable shift cutout performance. In addition, a shift cutout control method is provided to eliminate the need for a shift cutout switch, thus eliminating dependence on the quality of the shift cutout switch to provide desirable performance. Further, another object is to eliminate the need for maintaining a space in/around the engine for mounting the shift cutout switch. Furthermore, it is contemplated that in some embodiments, the shift cutout control system can be utilized with a watercraft for a watercraft propulsion unit.

In accordance with an embodiment, the shift cutout control system can include a shift mechanism, an electronic control unit, a remote controller, and an ignition control means. The shift mechanism can be operative to switch a rotation of a propeller shaft into neutral, forward, or reverse, with the propeller shaft being driven by an output power of an internal combustion engine. The engine electronic control unit can be operative to control a drive state of an internal combustion engine. The remote controller can be operative to transmit a control signal to the internal combustion engine electronic control unit to achieve a target drive state. The ignition control means can be operative to initiate an ignition cutout in the engine when an operating position signal from a lever position detector, which can be operative to detect an operating position of the control lever, indicates that the control lever is in a neutral position and when a shift position signal from a shift position detector indicates a shift position is not in neutral.

In another embodiment, the ignition control means can be operative to terminate the ignition cutout of the internal combustion engine while the shift cutout is implemented by the ignition control means, if the operating position signal from the lever position detector indicates the control lever position is not in a neutral position.

In yet another embodiment, the ignition control means can be operative to terminate the ignition cutout of the internal combustion engine while the shift cutout is implemented by the ignition control means if the shift position signal from the shift position detector indicates that the shift position has been kept in a neutral position for a predetermined period of time or longer.

In yet another embodiment, a plurality of shift position detectors have multiple circuits that are in electrical communication with the ignition control means and the shift position detector.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENTS

The following is a description of embodiments that are arranged and configured in accordance with certain features, aspects and advantages of the present inventions. This description makes reference to FIGS. 1-5. As shown therein, FIGS. 1-5 illustrate an embodiment of an outboard motor comprising a shift cutout control system. The embodiments disclosed herein are described in the context of a marine propulsion system of a watercraft because these embodiments have particular utility in this context. However, the embodiments and inventions herein can also be applied to other marine vessels, personal watercraft, boats, such as small jet boats, as well as other land and marine vehicles. It is to be understood that the embodiments disclosed herein are exemplary but non-limiting embodiments, and thus, the inventions disclosed herein are not limited to the disclosed exemplary embodiments.

Figure 1:
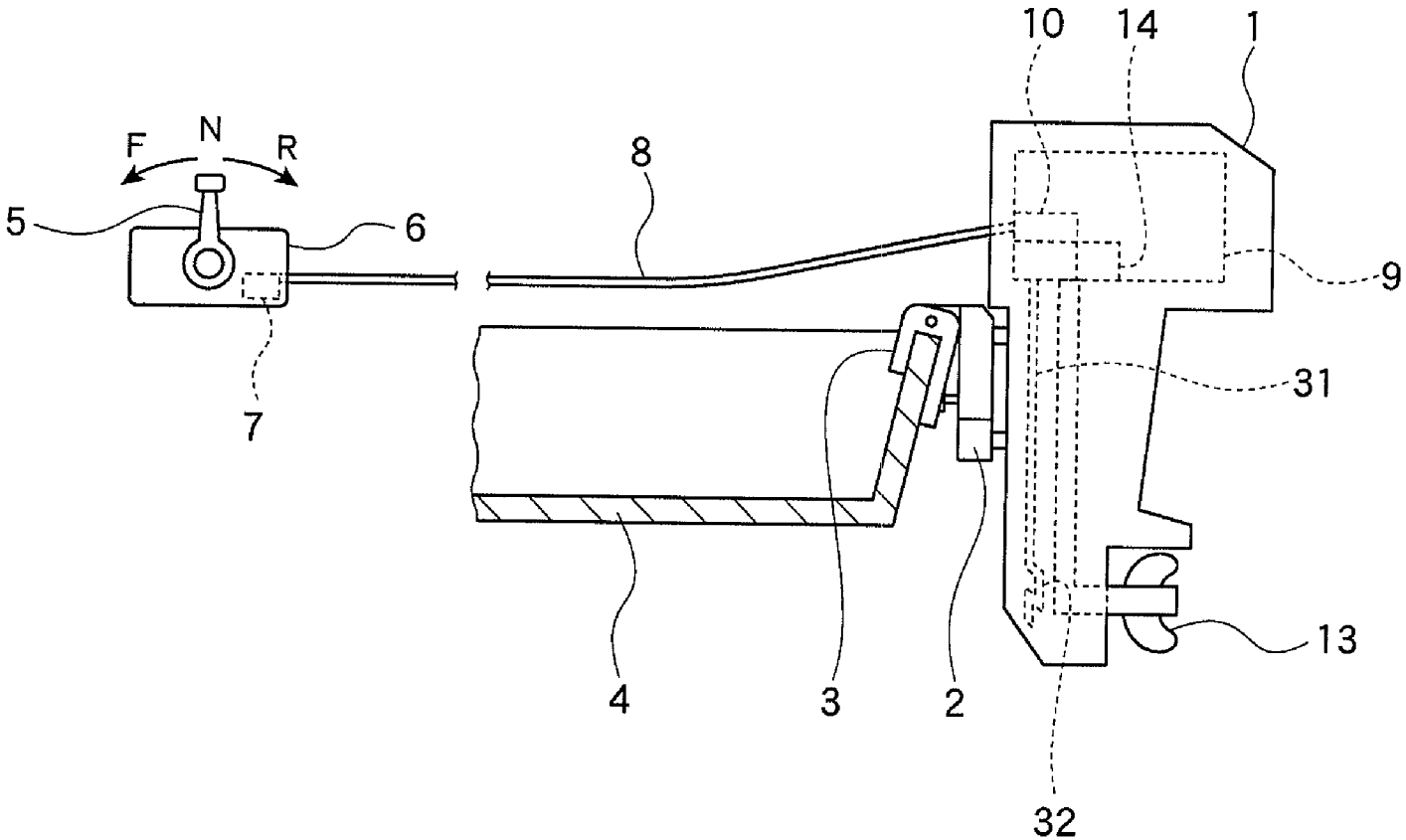
FIG. 1 is a diagram showing a structure of a gear shift drive operation system related to a shift cutout control system of a watercraft, according to an embodiment arranged and configured in accordance with certain features, aspects and advantages of the present inventions.

FIG. 1 is a diagram showing a structure of a gearshift drive operation system related to a shift cutout control system, according to an embodiment that is arranged and configured in accordance with certain features, aspects and advantages of the present inventions. As shown therein, an outboard motor 1 can be mounted to a watercraft 4 by means of a bracket 2 and a clamp bracket 3. A remote controller 6 can be provided in the vicinity of a watercraft operator's seat, for instance, for facilitating control of the outboard motor 1. In an exemplary configuration, an electronic control unit 7 can be mounted in the remote controller 6 (hereinafter referred to as the "remote-side ECU 7" or "ECU 7"). The remote-side ECU 7 can be in electrical communication with an electronic control unit 10 that can be mounted to an internal combustion engine 9 (hereinafter referred to as the "engine-side ECU 10" or "ECU 10") of the outboard motor 1.

Figure 2:
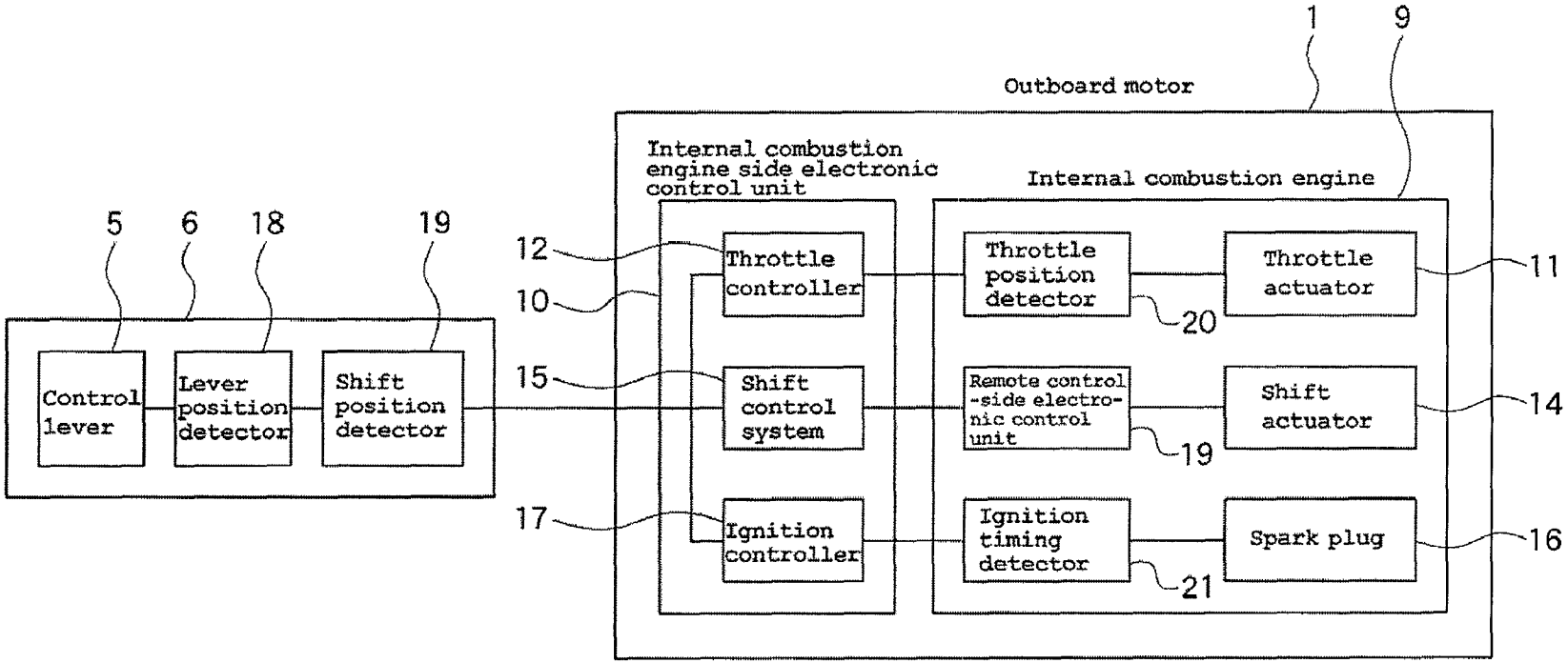
FIG. 2 is a functional block diagram of the shift cutout control system, according to another embodiment.

FIG. 2 is a functional block diagram of the shift cutout control system, that is arranged and configured in accordance with certain features, aspects and advantages of an embodiment of the present inventions. As illustrated in FIG. 2, the engine-side ECU 10 can include a throttle controller 12, a shift control system 15, and an ignition controller 17. The throttle controller 12 of the engine-side ECU 10 can be used for controlling operation of the throttle actuator 11. In this regard, the ECU 10 can determine an operational state of the internal combustion engine 9 in the outboard motor 1. The shift control system 15 can control operation of a shift actuator 14 of the engine 9. For example, the shift control system 15 can use the shift actuator 14 for starting or stopping a shift to switch drive power from the internal combustion engine 9 among "forward," "neutral," and "reverse." Finally, the ignition controller 17 (also referred to as an ignition control means) can be utilized to control ignition timing of a spark plug 16.

Additionally, as shown in FIG. 2, the remote controller 6 can include a control lever 5 for operating a gear shift. In some embodiments, the control lever 5 is a throttle that can be pivotably moveable. The remote controller 6 can also include a lever position detector 18 that can be capable of detecting a rotational position of the control lever 5. Further, the lever position detector 18 can sequentially detect an operation state (or operation position) of the lever 5. The ECU 7 can then transmit a lever position signal to the ECU 10 which can correspond to the detected value of the operation state of the lever 5.

The shift controller 15 of the engine-side ECU 10 can send a shift control signal to control operation of the shift actuator 14 based at least in part upon an operation state (operation position) of the control lever 5. The engine 9 can include a shift position detector 19 that can be operative at least to monitor the movement of the shift actuator 14. In response to any movement of the shift actuator 14, the shift position detector 19 can send a shift position signal to the shift controller 17 as feedback to indicate a shift position such as "forward," "neutral," and "reverse." To achieve a similar feedback control, the throttle position detector 20, which can be used to detect an operation state of the throttle actuator 11, can be connected with the throttle control device 12. Further, the ignition timing detector 21, which can be used to detect an operation state of the spark plug 16, can be connected with the ignition control device 17.

In some embodiments, the shift position detector 19 can include multiple circuits to facilitate connection with the ignition controller 17. In this manner, the reliability of the shift cutout control system can be improved because the normal shift cutout can be achieved even in the case of failure in the shift position detector 19 or in the circuit between the ignition controller 17 and the shift position detector 19.

Figure 3:
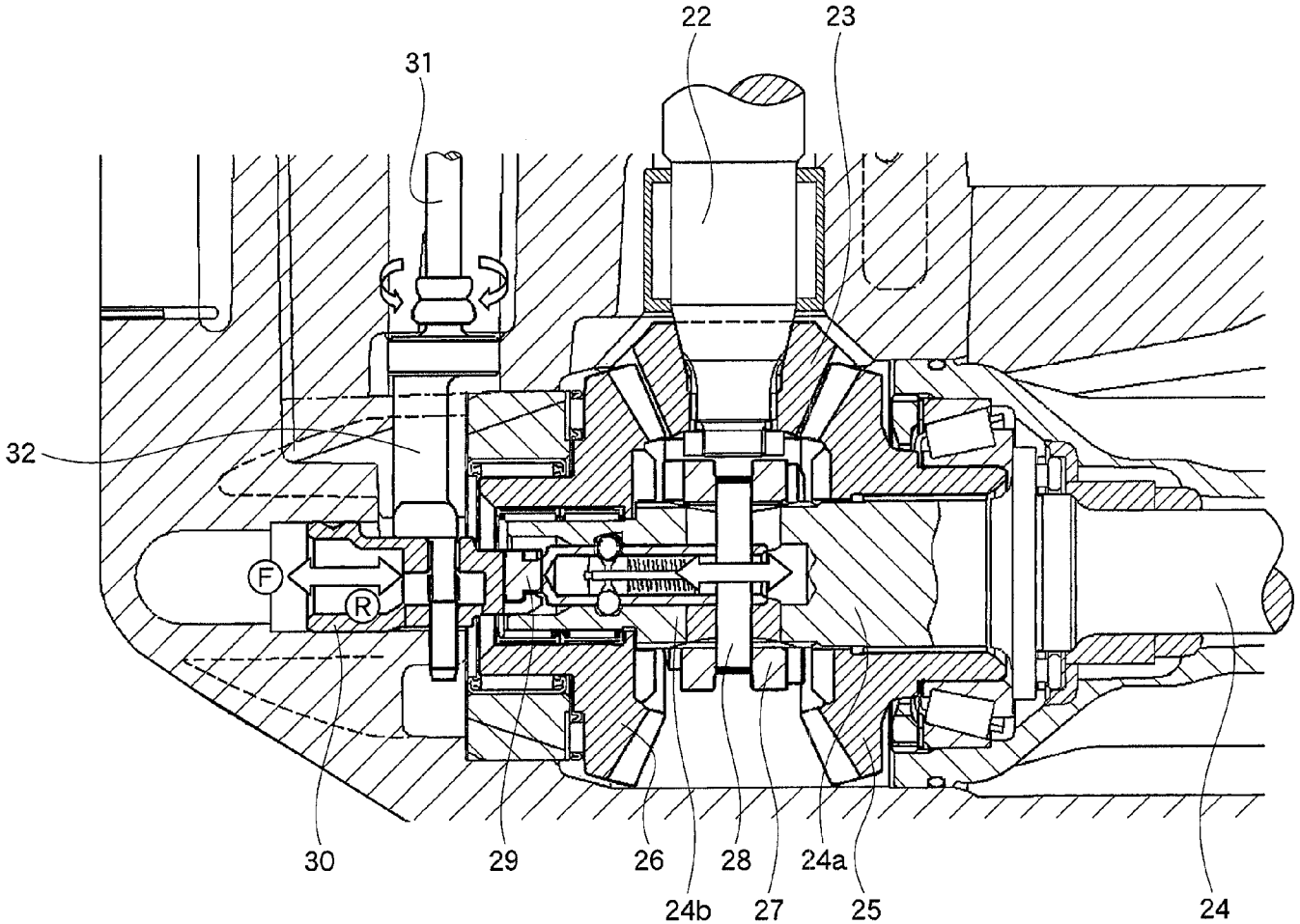
FIG. 3 is a partial cross-sectional view showing a portion of a power transmission mechanism of an outboard motor, according to yet another embodiment.

FIG. 3 is a partial cross-sectional view showing a portion of a power transmission mechanism in of an outboard motor 1. A crank shaft (not shown) of the internal combustion engine 9 can be arranged with its axis being oriented in a perpendicular direction, and the drive shaft 22 can be connected to its end. The pinion 23 can be fixed to the bottom end of the drive shaft 22. In addition, the propeller shaft 24, which is connected with the propeller 13, can be oriented orthogonally relative to the drive shaft 22. The forward gear 25 and the reverse gear 26 can be disposed on the propeller shaft 24. Each of the forward gear 25 and the reverse gear 26 can engage with the pinion 23 to rotate in opposite directions from each other. The dog clutch 27, which can slide in a axial direction relative to the propeller shaft 24, can be disposed between the forward gear 25 and the reverse gear 26. The dog clutch 27 can be configured to engage with either of the forward gear 25 or the reverse gear 26, as desired.

FIG. 3 illustrates the power transmission mechanism in a neutral state, in which the dog clutch 27 does not engage either of the forward gear 25 or the reverse gear 26. In some embodiments, the propeller shaft 24 can comprise a rear shaft 24*a* and a front shaft 24*b*. The dog clutch 27 can be connected via spline connection with the front shaft 24*b* of the propeller shaft 24. Thus, the dog clutch 27 can slide in the longitudinal or axial direction of the propeller shaft 24 while in splined connection with the front shaft 24*b* to facilitate rotation thereof with the propeller shaft 24.

The dog clutch 27 can be connected with the slider 29, which can slide in the axial direction of the propeller shaft 24 with the crossing pin 28. The slider 29 can be configured with a front head end connected with the shifter 30 to facilitate rotation. The shifter 30 can be connected by a cam linkage with a cam 32. The cam 32 can be coupled to a bottom end of a shift rod 31. When the shift rod 31 is rotated around the axis to rotate the cam 32, the shifter 30 can move to the front (F) or to the rear (R) accordingly. Thus, the shifter 30 can slide back and forth to cause the dog clutch 27 to engage with either of the forward gear 25 or the reverse gear 26. In this manner, a rotation of the pinion 23 can be transmitted to the front shaft portion 24*b* as a rotational force in the forward direction or in the reverse direction. Subsequently, the rotational force transmitted to the front shaft portion 24*b* is passed to the rear shaft portion 24*a*, which can be coupled thereto.

Figure 4:
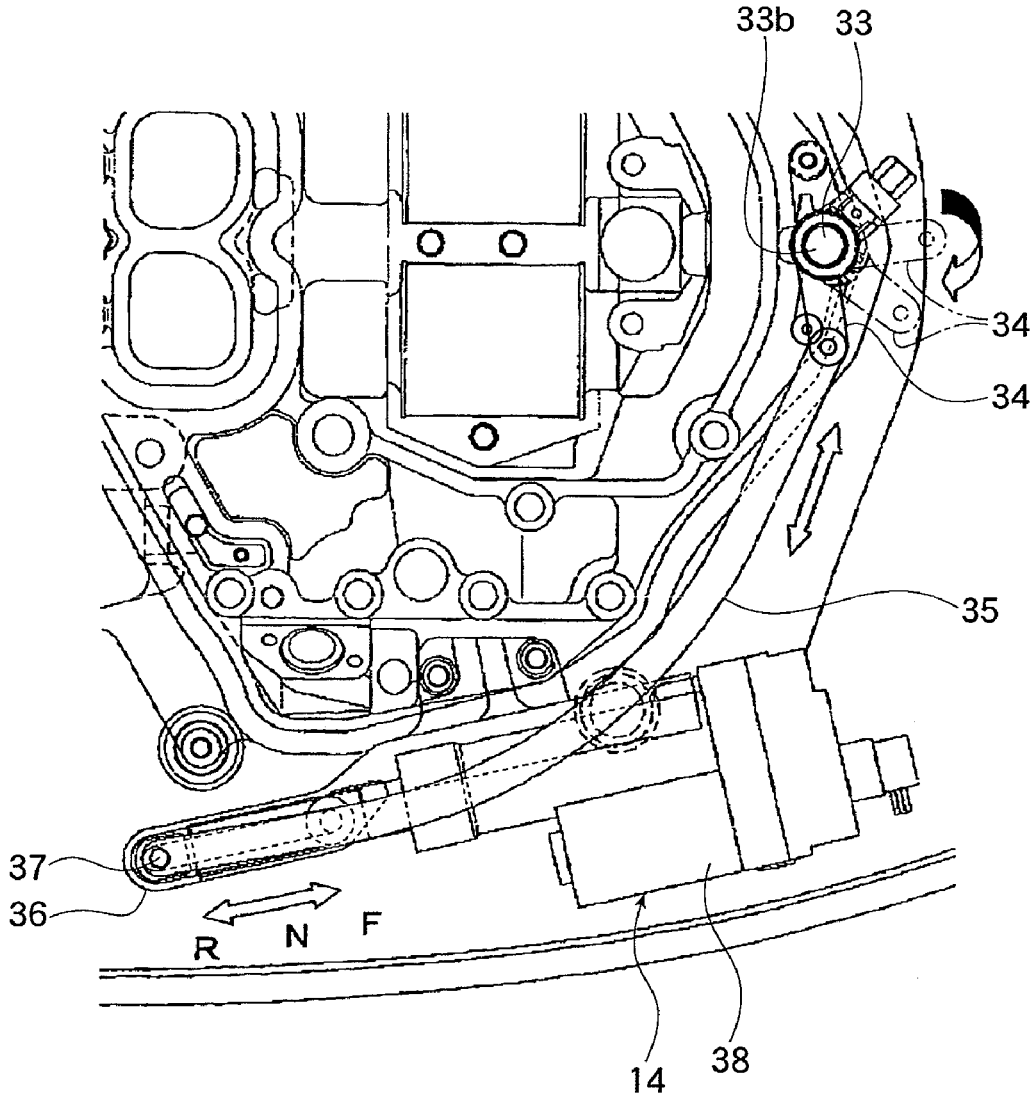
FIG. 4 is a plan view of a shift actuator and other components of the watercraft, according to a further embodiment.

As shown in FIG. 4, an upper end 33 of the shift rod 31 can be extended vertically and a lever 34 can be attached thereto. The outboard motor 1 can be configured such that an end of a lever shift arm 35 is pivotally coupled to an end of the lever 34. Additionally, another end of the lever shift arm 35 can be pivotally coupled to the slider 37. The slider 37 can be coupled to a shift rail 36 in a slidable manner. Thus, as the slider 37 slides in a predetermined direction by means of the shift actuator 14, the shift rod 31 can be rotated by way of the lever shift arm 35 and the lever 34.

As also illustrated in FIG. 4, the motor 1 can also include a shift motor 38 for actuating the shift lever arm 35. The shift motor 38 can be a DC motor that is operative to provide driving power. The shift motor 38 can include a reduction gear mechanism and the shift actuator 14, which drive the slider 37 in the predetermined direction.

Figure 5:
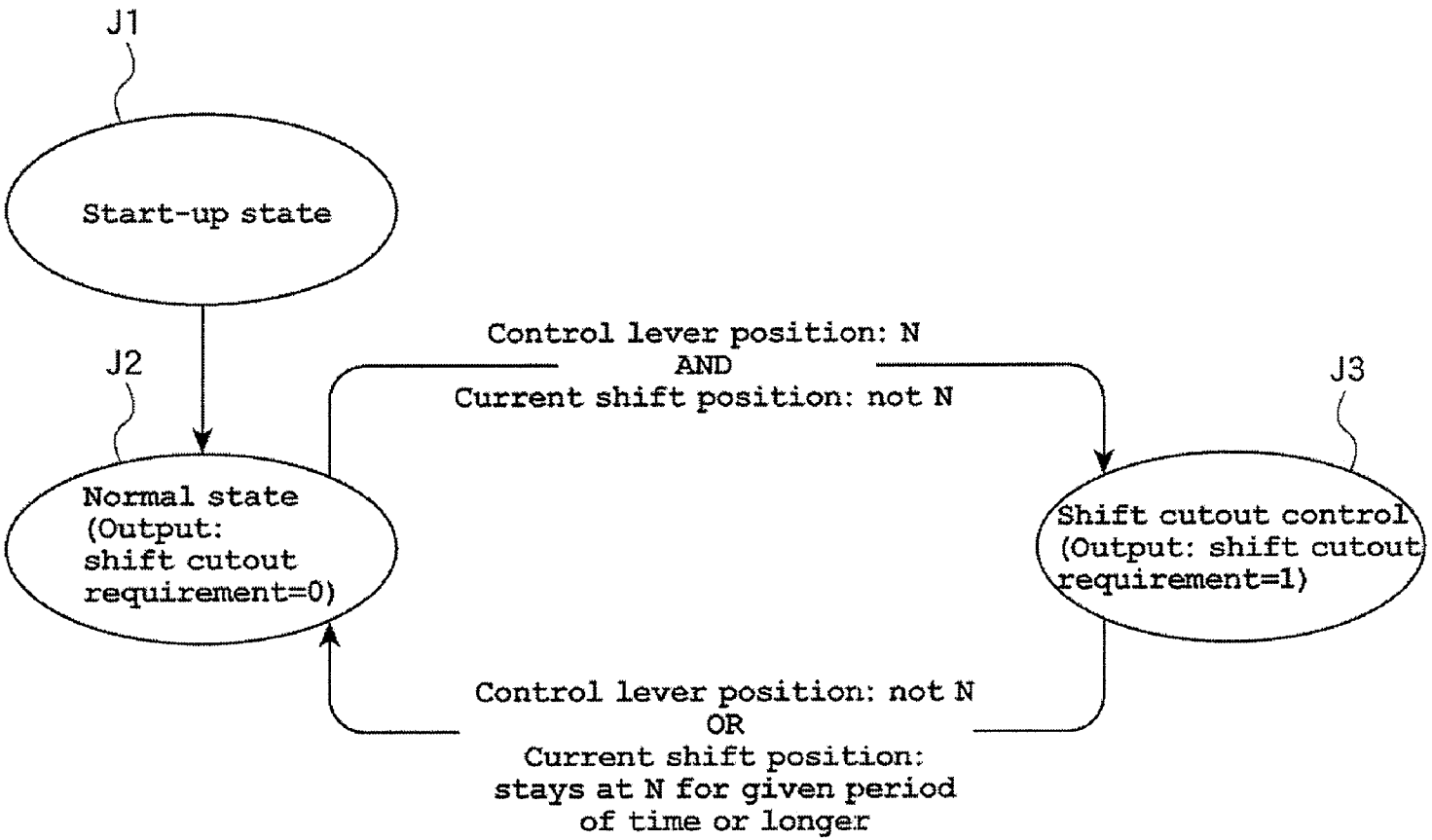
FIG. 5 is a state transition diagram of the shift cutout control system according to yet another embodiment.
Figure 6:
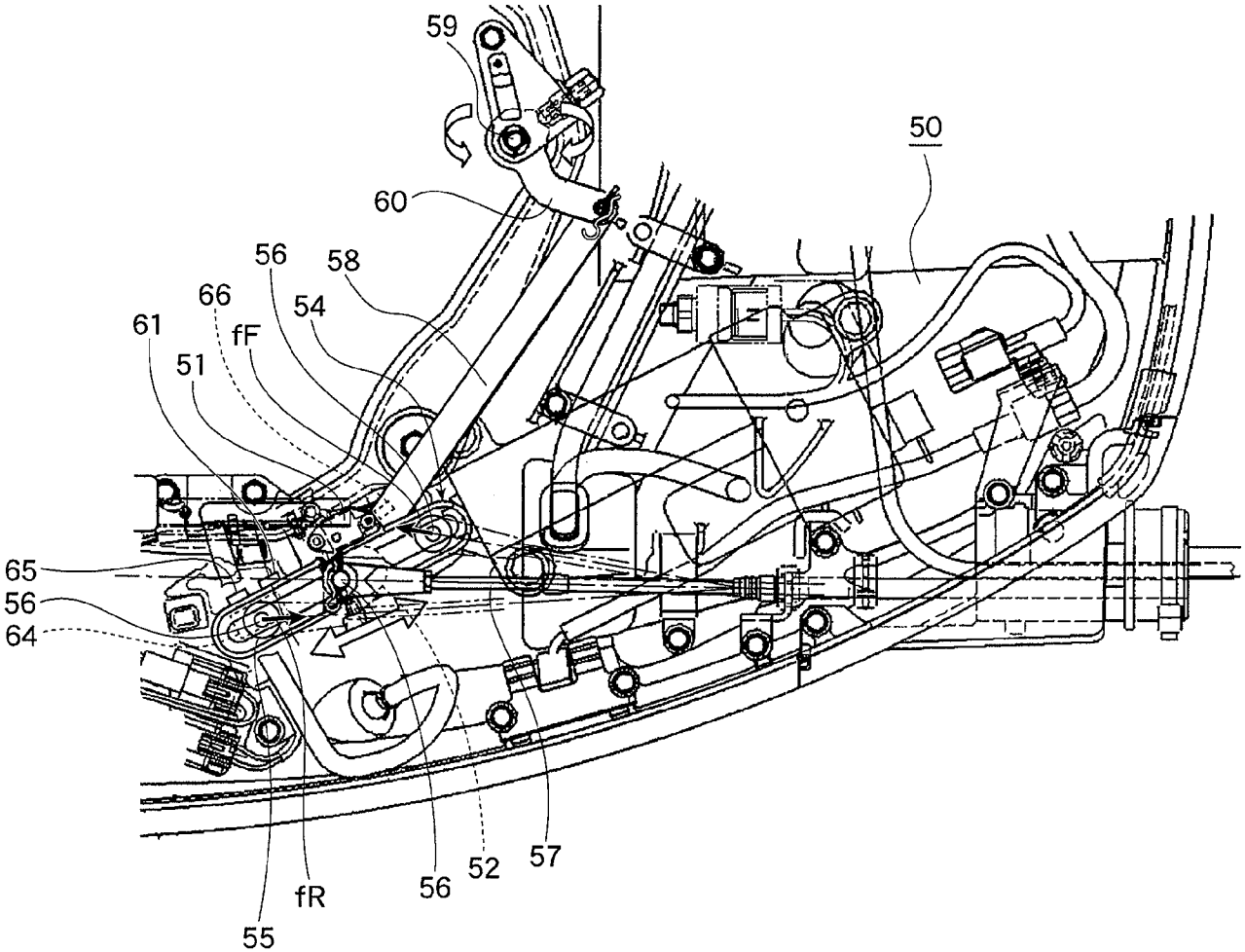
FIG. 6 is a plan view showing a relationship between a prior art remote control cable and a shift mechanism in a prior art outboard motor.
Figure 7:
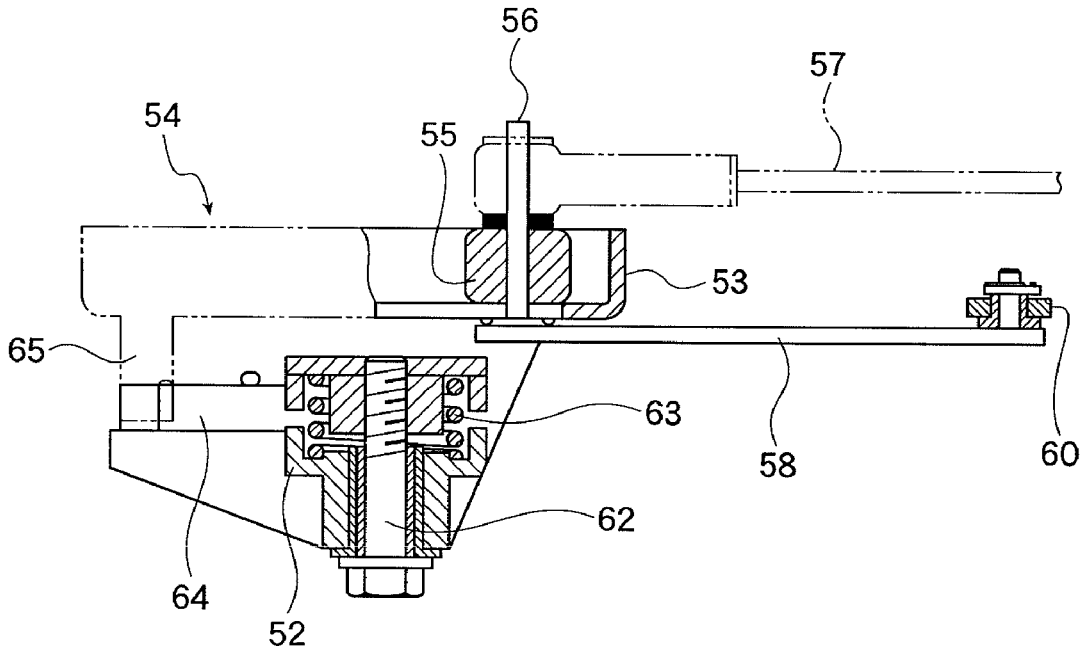
FIG. 7 is a partial cross-sectional side view of the motor shown in FIG. 6.

FIG. 5 illustrates a state transition diagram that will now be used to describe an embodiment of the operation of the illustrated shift cutout control system. As mentioned in regard to an embodiment discussed above, the shift cutout control system can use the shift position detector 19 for detecting a current shift position of the internal combustion engine 9 and for transmitting the detected information to the remote-side ECU 7 by way of the engine-side electronic control unit 10.

In addition, the lever position detector 18 can be used for detecting the current operating position of the control lever 5, and for transmitting the detected data to the remote-side ECU 7. Thus, the remote-side ECU 7 can receive both the input of the shift position data and the operating position data of the control lever 5. Further, an arithmetical unit (not shown) in the remote-side ECU 7 can process these input data to perform control operations for developing instructions related at least to the required ignition cutout. Instructions regarding the control operations and the extent of ignition cutout required for controlling the internal combustion engine 9 can then be transmitted to the ignition controller 17.

More specifically, once the main switch of the shift cutout control system is turned on, a start-up state J1 changes into a normal state J2 as shown in FIG. 5. While the system is in the normal state J2, a signal for initiating the ignition cutout on the internal combustion engine 9 can be transmitted to the ignition controller 17 if the operating position signal from the lever position detector 18 indicates that the control lever 5 is in a neutral position and the shift position signal from the shift position detector 19 indicates that the shift position is neutral. Then, the ignition controller 17 can enter the shift cutout state J3, suspending the ignition caused by the spark plug 16. The shift cutout state J3 can be in accordance with predetermined ignition cutout conditions corresponding to the rotational speed of the internal combustion engine 9 in the relevant running phase. The predetermined ignition cutout conditions can include, for example, a determination of the number of cylinders in which the ignition is suspended.

The shift cutout state J3 can be canceled to resume the normal state J2. In some embodiments, a signal for terminating the ignition cutout on the engine 9 can be transmitted to the ignition controller 17. For example, the lever position detector 18 can transmit the operation position signal indicating that the control lever 5 is not in a neutral position and accordingly, the shift cutout state J3 can be canceled to resume the normal state J2. In another example, the shift position detector 19 can transmit the shift position signal indicating that the control lever 5 has been in a neutral shift position for at least a given period of time or that the shift position is neutral. In such cases, a signal for terminating the ignition cutout on the internal combustion engine 9 can be transmitted to the ignition controller 17 to cancel the shift cutout state J3 and to resume the normal state J2.

In accordance with some embodiments, the shift cutout reduces the torque of the engine 9 to facilitate shifting of the gears into neutral, for instance. As described above, the torque can be reduced by suspending the operation of the engine 9 through the ignition cutout of the engine 9. The shift cutout can therefore change the number of ignition suspended cylinders in accordance with the rotational speed of the engine 9. For example, in the case of a six-cylinder internal combustion engine, ignition cutout may require that the ignition is suspended in: (1) all six cylinders if the engine speed is at or over about 8000 rpm; (2) five cylinders if the engine speed is between approximately 1500 rpm to approximately 8000 rpm; (3) four cylinders if the engine speed is between approximately 850 rpm to approximately 1500 rpm; (4) three cylinders if the engine speed is between approximately 700 rpm to approximately 850 rpm; (5) two cylinders if the engine speed is between approximately 600 rpm to approximately 700 rpm; (6) one cylinder if the engine speed is between approximately 500 rpm to approximately 600 rpm; and (7) none of the cylinders if the rotational speed of the engine is less than approximately 500 rpm.

Therefore, in accordance with one of the embodiments disclosed herein, a compact and highly reliable shift cutout control system is provided that can eliminate the need for a shift cutout switch requiring mechanical or manual operation. Embodiments can simplify operation of the motor 1 by monitoring the operating position of the control lever 5 and the rotational speed of the engine 9. When necessary or desired, the ignition controller 17 can automatically initiate ignition cutout of the engine 9. Thus, shift cutout performance is not dependent on the quality of a shift cutout switch.

In addition, it is contemplated that the shift cutout control system can remain active even though the shift cutout is terminated. Thus, after shift cutout has been triggered, and the operating position signal is transmitted to the ignition controller 17 indicating that the position of the control lever 5 is not in a neutral position, the ignition controller 17 can terminate the ignition cutout in the engine 9. In such a circumstance, the shift cutout control system can continue to operate accordingly.

Further, the shift cutout can be maintained when the shift position sensor indicates the control lever 5 is in the neutral position, regardless of the fact that the gearshift is still engaged. Continued engagement of the gearshift after the control lever 5 is in the neutral position can be caused by torsional deformation of the long shift rod 31. Some embodiments can tend to mitigate against such continued engagement of the gearshift by maintaining the shift cutout; this can be performed, as mentioned above, with the ignition controller 17 terminating the ignition cutout of the engine 9 only after the shift position signal has identified the neutral shift position for at least a given period of time. Alternatively, embodiments are provided wherein the shift position signal can indicate the neutral shift position and thereby facilitate disengagement of the gearshift.

Still further, embodiments disclosed herein can be beneficially employed in vehicles such as watercraft and the like. For example, as mentioned above, embodiments of the shift cutout control system can eliminate the need for manual operation of the shift cutout switch to effect shift cutout. Further, shift cutout performance of the watercraft would not depend on the quality of the shift cutout switch. In addition, embodiments disclosed herein could provide a highly reliable shift cutout system for a watercraft or other vehicle and eliminate the need for providing an area in or around an engine 9 for mounting a shift cutout switch.

Embodiments of the shift cutout control system can be configured such that the engine-side ECU 10 of the engine 9 and the remote-side ECU 19 of the remote controller 6 can operate in combination with each other to carry out the target control. However, the present inventions are not limited to the above-mentioned embodiments. Alternative constructions and configurations may be applied in which one or more functions of the remote-side ECU 19 can be incorporated into the engine-side ECU 10 to eliminate the remote-side ECU 19, for instance.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A shift cutout control system for a watercraft propulsion unit, the system comprising:

a shift mechanism adapted to switch a rotation of a propeller shaft among a neutral drive state, a forward drive state, and a reverse drive state, the propeller shaft being driven by an output power of an internal combustion engine;

an internal combustion engine electronic control unit adapted to control a drive state of the internal combustion engine;

a remote controller capable of transmitting a control signal to the internal combustion engine electronic control unit to achieve a target drive state; and an ignition control device adapted to initiate an ignition cutout in the internal combustion engine when an operating position signal from a lever position detector that is configured to detect an operating position of a control lever indicates the control lever is in a neutral position and a shift position signal from a shift position detector indicates that a shift position is not in neutral.

2. The system of claim 1, wherein the ignition control device is operative to terminate the ignition cutout of the internal combustion engine while the shift cutout is implemented by the ignition control device when the operating position signal from the lever position detector indicates that the control lever position is not in a neutral position.

3. The system of claim 1, wherein the ignition control device is operative to terminate the ignition cutout of the internal combustion engine while the shift cutout is implemented by the ignition control means when the shift position signal from the shift position detector indicates that the shift position has been in neutral for at least a predetermined period of time.

4. The system of claim 1 further comprising a plurality of shift position detectors having multiple circuits that are in electrical communication with the ignition control device and the shift position detector.

5. A watercraft comprising the shift cutout control system of claim 1.

6. A shift cutout control system for watercraft propulsion unit, the system comprising:

a shift mechanism configured to switch a rotation of a propeller shaft to a target drive state being one of neutral, forward, and reverse, the propeller shaft being driven by an internal combustion engine;

a lever position detector being operative to detect an operating position of a control lever and to transmit an operating position signal being representative of the operating position;

a shift position detector being operative to detect a shift position and to transmit a shift position signal being representative of the shift position;

an engine electronic control unit configured to control a drive state of the engine;

a remote controller being in electrical communication with the lever position detector, the shift position detector, and the engine electronic control unit, the remote controller being operative to receive the operating position signal and the shift position signal from the respective ones of the lever position detector and the shift position detector, the remote controller being operative to transmit one of the operating position signal and the shift position signal to the engine electronic control unit to achieve the target drive state; and an ignition control device that is in electrical communication with the engine electronic control unit and that is operative to initiate an ignition cutout in the engine in response to the operating position signal and the shift position signal.

7. The system of claim 6, wherein the ignition control device initiates an ignition cutout when the operation position signal indicates that the control lever is in a neutral position and the shift position signal indicates that the shift position is not neutral.

8. The system of claim 6, wherein the ignition control device is operative to terminate the ignition cutout of the internal combustion engine while the shift cutout is implemented by the ignition control means when the operating position signal from the lever position detector indicates that the control lever position not in a neutral position.

9. The system of claim 6, wherein the ignition control device is operative to terminate the ignition cutout of the internal combustion engine while the shift cutout is implemented by the ignition control means when the shift position signal from the shift position detector indicates that the shift position has been in neutral for at least a predetermined period of time.

10. The system of claim 6 further comprising a plurality of shift position detectors having multiple circuits that are in electrical communication with the ignition control device and the shift position detector.

11. A watercraft comprising the shift cutout control system of claim 6.

12. A shift cutout control system for a watercraft propulsion unit, the water propulsion unit comprising a propeller shaft, an internal combustion engine driving the propeller shaft, a shiftable transmission positioned between the internal combustion engine and the propeller shaft, the shiftable transmission being shiftable among a neutral state, a forward drive state, and a reverse drive state, an engine electronic control unit being in electrical communication with the engine, a remote controller being electrical communication with the engine electronic control unit, the remote controller being configured to transmit a control signal to the engine electronic control unit to achieve a target drive state, the engine comprising an ignition control device that is in electrical communication with an ignition component of the engine, the ignition control device being configured to at least partially interrupt ignition when an operating position signal from a lever position detector indicates a control lever is in a neutral position and a shift position signal from a shift position detector indicates that a shift position is not in neutral.

13. The system of claim 12, wherein the propeller shaft is drivingly connected to a propeller.

14. A shift cutout control system for a watercraft propulsion unit, the water propulsion unit comprising a propeller shaft, an internal combustion engine driving the propeller shaft, a shiftable transmission positioned between the internal combustion engine and the propeller shaft, the shiftable transmission being shiftable among a neutral state, a forward drive state, and a reverse drive state, an engine electronic control unit being in electrical communication with the engine, a remote controller being electrical communication with the engine electronic control unit, the remote controller being configured to transmit a control signal to the engine electronic control unit to achieve a target drive state, the engine comprising means for interrupting ignition when an operating position signal from a lever position detector indicates a control lever is in a neutral position and a shift position signal from a shift position detector indicates that a shift position is not in neutral.

* * * * *